US007020290B1

(12) United States Patent
Ribic

(10) Patent No.: US 7,020,290 B1
(45) Date of Patent: Mar. 28, 2006

(54) METHOD AND APPARATUS FOR PICKING UP SOUND

(76) Inventor: Zlatan Ribic, Anton Baumgartner Strasse 44/A8/052, A-1232, Vienna (AT)

( * ) Notice: Subject to any disclaimer, the term of this patent is extended or adjusted under 35 U.S.C. 154(b) by 663 days.

(21) Appl. No.: 10/110,073

(22) PCT Filed: Sep. 23, 2000

(86) PCT No.: PCT/EP00/09319

§ 371 (c)(1),
(2), (4) Date: Apr. 5, 2002

(87) PCT Pub. No.: WO01/26415

PCT Pub. Date: Apr. 12, 2001

(30) Foreign Application Priority Data

Oct. 7, 1999 (EP) ..... 99890319

(51) Int. Cl.
*H04R 3/00* (2006.01)

(52) U.S. Cl. ..... 381/92; 381/313; 381/356; 381/122

(58) Field of Classification Search ..... 381/1, 381/17, 92, 356, 357, 313, 312
See application file for complete search history.

(56) References Cited

U.S. PATENT DOCUMENTS 4,399,327 A * 8/1983 Yamamoto et al. ..... 381/92
6,041,127 A * 3/2000 Elko ..... 381/92
6,449,368 B1 * 9/2002 Davis et al. ..... 381/1
6,618,485 B1 * 9/2003 Matsuo ..... 381/92

* cited by examiner

*Primary Examiner*—Brian T. Pendleton
(74) *Attorney, Agent, or Firm*—Sonnenschein Nath & Rosenthal LLP

(57) ABSTRACT

The invention relates to a method for picking up sound comprising the following steps providing at least two essentially omnidirectional microphones (1*a*, 1*b*, 1*c*) or membranes (9*a*, 9*b*) which have a mutual distance (d) shorter than a typical wave length of the sound wave; combining these microphones (1*a*, 1*b*, 1*c*) or membranes (9*a*, 9*b*) to obtain directional signals (F(t), R(t) depending on the direction (3) of sound; and processing the directional signals (F(t), R(t) to modify the directional pattern of the signals.

7 Claims, 6 Drawing Sheets

Fig.4a
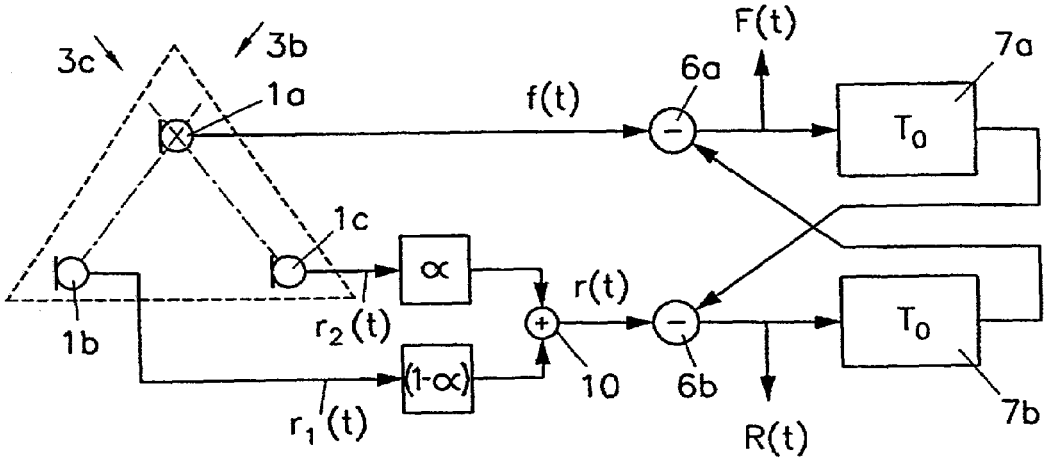
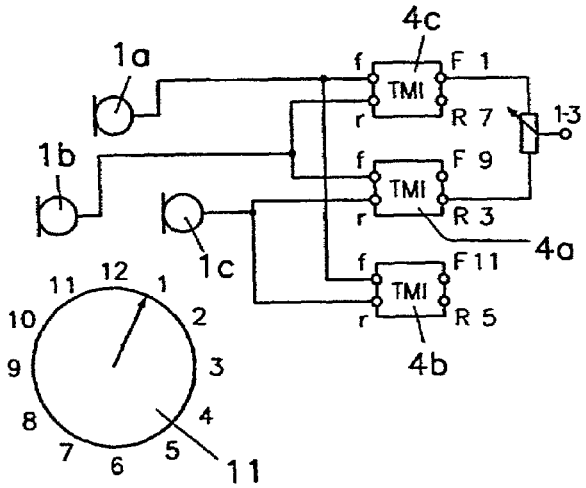
Fig.4b
Fig.5
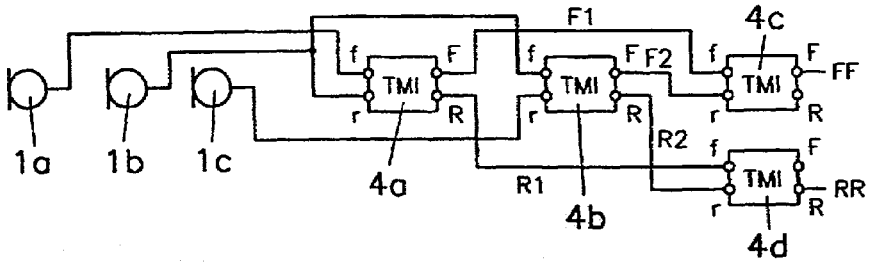

7a
7b
6
13
12
1a
1b
+7.6V
-7.6V
6M
6k8
100n
4u7
100k
074
2k2
33k
Fo
Ro
2k7
22k
4088
Q
1n
16k
47u
470n
47k
9k1
100k log
220k
Fout
Rout
dir.
omni.
N.C.
4093
12us
20us
68k
200p

METHOD AND APPARATUS FOR PICKING UP SOUND

BACKGROUND OF THE INVENTION

The invention relates to a method and an apparatus for picking up sound.

In a hearing aid, sound is picked up, amplified and at in end transformed to sound again. In most cases omnidirectional microphones are used for picking up sound. However, in the case of omnidirectional microphones, the problem occurs that ambient noise is picked up in the same way. It is known to enhance the quality of signal transmission by processing a signal picked up by the hearing aid. For example, it is known to split the signal into a certain number of frequency bands and to amplify preferably those frequency ranges in which the useful information (for example speech) is contained and to suppress those frequency ranges in which usually ambient noise is contained. Such signal processing is very effective if the frequency of ambient noise is different from the typical frequencies of speech. There is little help in the so-called "party situation", in which the useful signal is speech of one person and noise consists of speech of a lot of other people. To overcome this problem it has been proposed to use directional microphones with a cardioid or hyper-cardioid characteristic. In such cases sound of sources in front of the person wearing the hearing aid is amplified and sound from other directions is suppressed. Directional microphones are often used in these situations, but they have several serious disadvantages. For instance, the directional microphones are bulky, usually have higher equivalent input noise, and are extremely sensitive to wind. The situation becomes even more problematic when stereo or surround record is required. Then, it is necessary to use more microphones. U.S. Pat. No. 5,214,709 teaches that usually pressure gradient microphones are used to pick up the sound at two points with a certain distance to obtain a directional recording pattern. The largest disadvantage of the simple small directional microphones is that they measure air velocity, not sound pressure, therefore their frequency response for the sound pressure has a +6 dB/octave slope. This means that their pressure sensitivity in the range of low frequencies is much lower than at high frequencies. If inverse filtering is applied the microphone's own noise is also amplified on the low frequencies and the signal to noise ratio remains as bad as it was before the filtering. The second problem is that if the directional microphone is realized with two omnidirectional pressure microphones, their matching is critical and their frequency characteristic depends very much on the incoming sound direction. Therefore, the inverse filtering is not recommended and can have a negative effect. Because of the mentioned reasons omnidirectional pressure microphones with linear frequency response and a good signal to microphone noise ratio on whole frequency range are mostly used for peaceful and silent environments. When the noise level is high, the directionality is introduced, and since the signal level is high, the signal to microphone noise ratio is not important.

Furthermore, U.S. Pat. No. 5,214,907 describes a hearing aid which can be continuously regulated between an omnidirectional characteristic and a unidirectional characteristic. The special advantage of this solution is that at least in the omnidirectional mode a linear frequency response can be obtained.

It is further known from M. Hackl, H. A. Müller: Taschenbuch der technischen Akustik, Springer 1959 to use double membrane systems for obtaining a directional recording pattern. Such systems are used in studios and professional applications. However, due to losses caused by membrane mass and friction the real capabilities are partially limited. It is not known to use such systems for hearing aids.

Some documents, e.g., EP 690 657 A, EP 869 697 A or U.S. Pat. No. 3,109,066 a disclose microphone systems in which the signals of microphones are delayed and these delayed signals are mixed with original signals of the microphones. In that way a cardioide pattern can be obtained for example. However, such feed forward solutions show a frequency response for the sound pressure having a +6 dB/octave slope. Generally this disadvantage can be partially overcome by selective amplification of the signals, but then noise is amplified too and the signal/noise ratio is deteriorated.

SUMMARY OF THE INVENTION

It is an object of the present invention to avoid the above disadvantages and to develop a method and a system which allows picking up sound with a directional sensitivity which is essentially independent of the frequency. Furthermore, it should be possible to control directionality continuously between a unidirectional and an omnidirectional characteristic and/or to change the direction or the type of the response.

The method of the invention is characterized by the steps of claim 1. Experiments have shown that with such a method a directional signal can be obtained which has a high quality and which in its behaviour is essentially independent of the frequency of the input signals. Depending on different parameters to be chosen a cardioid, hyper-cardioid or other directional characteristic can be obtained.

It has to be noted that a typical distance between the first and second microphone is in the range of 1 cm or less. This is small compared to the typical wavelength of sound which is in the range of several centimeters up to 15 meters.

The principal difference between the invention and the prior art is that it is a sort of feedback solution, that is the signal of a microphone is not delayed, but a composite signal which contains already delayed information. It has been found that in that way no dependency on frequency is observed.

In a preferred embodiment of the invention two subtractors are provided, each of which is connected with a microphone to feed a positive input to the subtractor, and wherein the output of each subtractor is delayed for a predetermined time and sent as negative input to the other subtractor. The output of the first subtractor represents a first directional signal and the output of the second subtractor represents a second directional signal. The maximum gain of the first signal is obtained when the source of sound is situated on the prolongation of the connecting line between the two microphones. The maximum gain of the other signal is obtained when the source of sound is on the same line in the other direction.

The above method relates primarily to the discrimination of the direction of sound. Based upon this method it is possible to analyze the signals obtained to further enhance the quality for a person wearing a hearing aid for example. One possible signal processing is to mix the first signal and the second signal. If for example both signals have the form of a cardioid with the maximum in opposite direction, a signal with a hyper-cardioid pattern can be obtained by mixing these two signals in a predetermined relation. It can be shown that a hyper-cardioid pattern has advantages compared to a cardioid pattern in the field of hearing aids, especially in noisy situations. Furthermore, it is possible to split the first signal and the second signal into sets of signals in different frequency ranges. Depending on an analysis of the sound in each frequency range different strategies can be chosen to select a proper directional pattern and a suitable amplification or suppression. For example, it is possible to have a strong directional pattern in the frequency bands in which the useful information of speech is contained, whereas in other frequency bands a more or less omnidirectional pattern prevails. This is an advantage since warning signals or the like should be noticed from all directions.

The present invention relates further to an apparatus for picking up sound with at least two essentially omnidirectional microphones, each of which is connected with an input port of a subtractor, a delaying unit with an input port connected with an output port of a first subtractor for delaying the output signal for a predetermined time. According to the invention an output port of the delaying unit is connected with a negative input port of a second subtractor.

According to a preferred embodiment of the invention, three microphones are provided wherein the signals of the second and the third microphone are mixed in an adder, with an output port of which being connected to the second subtractor. This allows shifting the direction of maximum gain within a given angle.

In an alternative embodiment of the invention, three microphones and three discrimination units are provided wherein the first microphone is connected to an input port of the second and the third discrimination unit, the second microphone is connected to an input port of the first and the third discrimination unit, and the third microphone is connected to an input port of the first and the second discrimination unit. In this way three sets of output signals are obtained so that there are six signals whose direction of maximum gain is different from each other. By mixing these output signals these directions may be shifted to any predetermined direction.

Preferably, more than three microphones are provided which are arranged at the corners of a polygon or polyhedron and wherein a set of several discrimination units is provided, each of which is connected to a pair of microphones. In the case of an arrangement in the form of a polygon all directions within the plane in which the polygon is situated can be discriminated. If the microphones are arranged at the corners of a polyhedron, the directions in three dimensional space may be discriminated. At least four microphones have to be arranged on the corners of a polyhedron.

A very strong directional pattern, like shotgun microphones with a length of 50 cm or more with a characteristic like a long telephoto lens in photography may be obtained if at least three microphones are provided which are arranged on a straight line and wherein a first and a second microphone is connected with the input ports of a first discrimination unit, and the second and the third microphone is connected to the input ports of a second discrimination unit and wherein a third discrimination unit is provided, the input ports of which are connected to an output port of the first and the second discrimination unit and wherein a fourth discrimination unit is provided, the input ports of which are connected to the other output ports of the first and the second discrimination unit.

BRIEF DESCRIPTION OF THE DRAWING

The invention is now described further by some examples shown in the drawings. The drawings show:

FIGS. 4*a* and 4*b* circuit diagrams of two variants of a further embodiment of the invention, FIG. 5 a circuit diagram of yet another embodiment of the invention, FIG. 6 a detailed circuit diagram of another embodiment, FIG. 7 a block diagram of a further embodiment of the invention, FIGS. 8, 9 and 10 typical directional patterns obtained by methods according to the invention.

DETAILED DESCRIPTION OF THE PREFERRED EMBODIMENT

Figure 1:
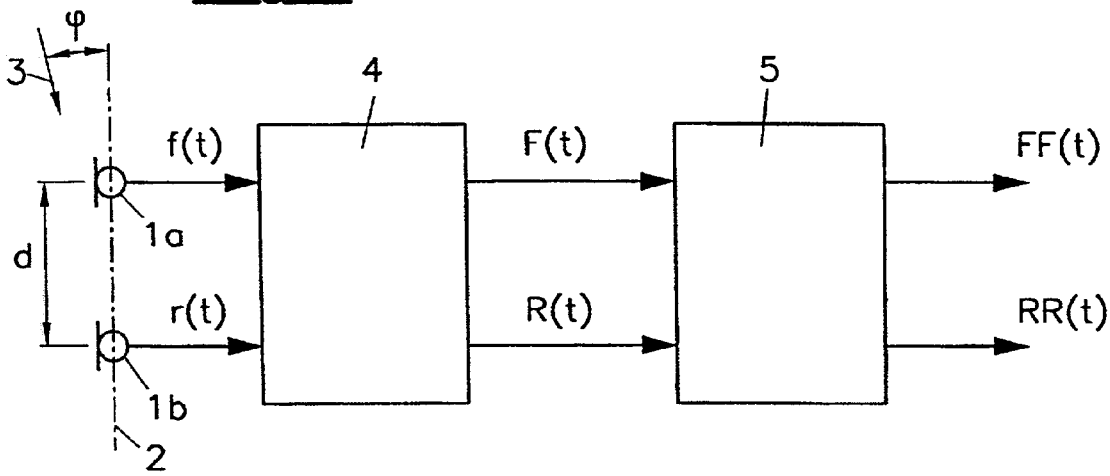
FIG. 1 a block diagram of an embodiment of the invention.

FIG. 1 shows that sound is picked up by two omnidirectional microphones 1*a*, 1*b*. The first microphone 1*a* produces an electrical signal f(t) and the second microphone 1*b* produces an electrical signal r(t). When the microphones 1*a*, 1*b* are identical, signals f(t) und r(t) are identical with the exception of a phase difference resulting from the different time of the sound approaching the microphones 1*a*, 1*b*. The signals of the microphones 1*a*, 1*b* fulfill the following equation:

$$r(t) = f\left(t - \frac{d}{c}\cos\varphi\right) \tag{1}$$

wherein d represents the distance between the microphones 1*a* and 1*b*, *c* sound velocity and ϕ the angle between the direction 3 of sound approaching and the connection line 2 between the microphones 1*a* and 1*b*.

Block 4 represents a discrimination unit to which signals f(t) and r(t) are sent. The outputs of the discrimination circuit 4 are designated F(t) and R(t). The amplitude of F(t) and R(t) depends on angle ϕ wherein a cardioid pattern is obtained for example. That means that the amplitude A of signals F and R corresponds to equation 2:

$$A = \frac{A_0}{2}(1 + \cos\varphi) \tag{2}$$

$A_0$ represents the maximum amplitude obtained if the source of sound is on the connection line 2 between microphones 1*a* and 1*b*, which means that the maximum amplitude of F(t) is at ϕ=0 and of R(t) at ϕ=π.

Signals F(t) and R(t) are processed further in the processing unit 5, the output of which is designated with FF(t) and RR(t).

Figure 2:
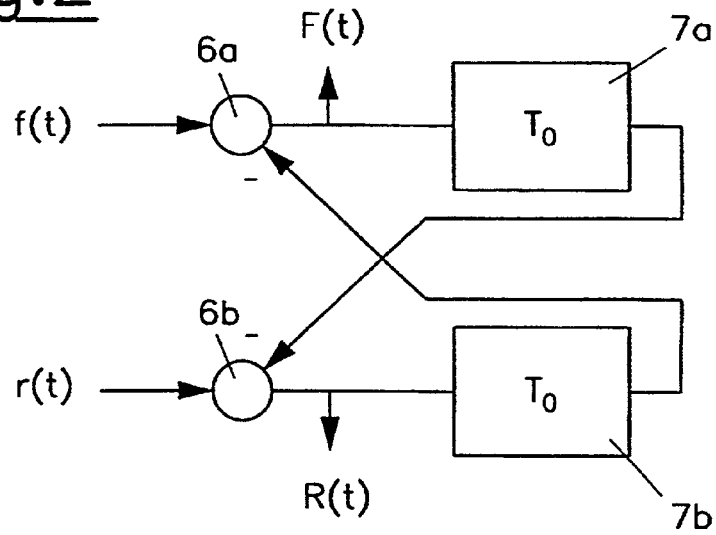
FIG. 2 a circuit diagram of the essential part of the invention.

In FIG. 2 the discrimination unit 4 is explained further. The first signal f(t) is sent into a first subtractor 6*a*, the output of which is delayed in a delaying unit 7*a* for a predetermined time $T_0$. Signal r(t) is sent to a second subtractor 6*b*, the output of which is sent to a second delaying unit 7*b*, which in the same way delays the signal for a time $T_0$. Furthermore, the output of the first delaying unit 7*a* is sent as a negative input to the second subtractor 6*b*, and the output of the second delaying unit 7*b* is sent as a negative input to the first subtractor 6*a*. The output signals F(t) and R(t) of the circuit of FIG. 2 are obtained as outputs of the first and the second subtractors 6*a*, 6*b* respectively. The following equations 3, 4 represent the circuit of FIG. 2 mathematically:

$$F(t)=f(t)-R(t-T_0) \tag{3}$$

$$R(t)=r(t)-F(t-T_0) \tag{4}$$

Figure 3:
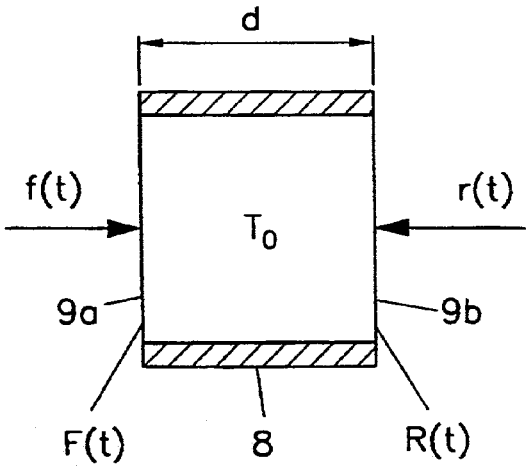
FIG. 3 a schematical view of a double membrane microphone.

A system according FIG. 2 simulates an ideal double membrane microphone as shown in FIG. 3. A cylindrical housing 8 is closed by a first membrane 9*a* and a second membrane 9*b*. The distance d between membranes 9*a* and 9*b* is chosen according equation (5):

$$d=cT_0 \tag{5}$$

In this case, signal F(t) can be obtained from the first membrane 9*a* and signal R(t) can be obtained from membrane 9*b*. It has to be noted that the similarity between the double membrane microphone and the circuit of FIG. 2 applies only to the ideal case. In reality results differ considerably due to friction, membrane mass and other effects.

The above system operates at the limit of stability. To obtain a stable system a small damping effect is necessary for the feedback signals. Therefore the above equations (3) and (4) are modified to:

$$F(t)=f(t)-(1-\epsilon)R(t-T_0) \tag{3a}$$

$$R(t)=r(t)-(1-\epsilon)F(t-T_0) \tag{4a}$$

with $\epsilon<<1$, being a constant ensuring stability.

It is obvious that the circuit of FIG. 2 only corresponds to a double membrane microphone when the delay $T_O$ is equal for the delaying units 7*a* and 7*b*. It is an advantage of the circuit of FIG. 2 that it is possible to have different delays $T_{0a}$ and $T_{0b}$ in the delaying units 7*a* and 7*b* respectively to obtain different output functions F(t) and R(t).

In the above embodiments the direction in which the maximum gain is obtained is defined by the connecting line between microphones 1*a* and 1*b*. The embodiments of FIGS. 4*a* and 4*b* make it possible to shift the direction in which the maximum gain is obtained without moving microphones. In FIG. 4*a*, as well as in FIG. 4*b*, three microphones 1*a*, 1*b*, 1*c* are arranged at the corners of a triangle. In the embodiment of FIG. 4*a*, signals of microphones 1*b* and 1*c* are mixed in an adder 10. The output of the adder 10 is obtained according to the following equation (6):

$$r(t)=(1-\alpha)r_1(t)+\alpha r_2(t) \tag{6}$$

With $0\leqq\alpha\leqq1$.

The processing of signals F(t) und R(t) occurs according to FIG. 2. For $\alpha=0$ the maximum gain for F(t) is obtained for sound approaching in direction 3*b* according to the connecting line between microphones 1*a* and 1*b*. On the other hand, if $\alpha=1$, maximum gain for F(t) is obtained for signals approaching in direction 3*c* according to the connection line between microphones 1*a* and 1*c*. For other values of $\alpha$ the maximum is obtained for sound approaching along a direction between arrows 3*b* and 3*c*.

In the embodiment of FIG. 4*b* there are three discrimination units 4*a*, 4*b* and 4*c*, each of which is connected to a single pair out of three microphones 1*a*, 1*b*, 1 *c*. Since microphones 1*a*, 1*b*, 1 *c* are arranged at the corners of an equilateral triangle, the maximum of the output functions of discrimination unit 4*c* is obtained in directions 1 and 7 indicated by clock 11. Maximum gain of discrimination unit 4*a* is obtained for directions 9 and 3 and the maximum gain of discrimination unit 4*a* is obtained for directions 11 and 5. The arrangement of FIG. 4*b* produces a set of six output signals which are excellent for recording sound with high discrimination of the direction of sound. For example, in a concert hall it is possible to pick up sound with only one small arrangement of three microphones contained in the housing of one conventional microphone with the possibility of recording on six channels giving an excellent surround impression. The directions mentioned above can be changed in a continuous way similar to embodiment shown in FIG. 4*a*, for example by mixing output function F from discrimination unit 4*c* with output function F from discrimination unit 4*a*. In this way the maximum gain can be directed to any direction between 1 and 3 on clock 11.

If four microphones (not shown) are arranged at the corners of a polyhedron, the directions of the maximum gain can not only be changed within a plane but also in three dimensional space.

The above embodiments have a directional pattern of first order. With an embodiment of FIG. 5 it is possible to obtain a directional pattern of higher order. In this case three microphones 1*a*, 1*b*, 1 *c* are arranged on a straight line. A first discrimination unit 4*a* processes signals of the first and the second microphone 1*a*, 1*b* respectively. A second discrimination unit 4*b* processes signals of the second and the third microphones 1*b* and 1*c* respectively. Front signal $F_1$ of the first discrimination unit 4*a* and front signal $F_2$ of the second discrimination unit 4*b* is sent into a third discrimination unit 4*c*. Rear signal $R_1$ of the first discrimination unit 4*a* and rear signal $R_2$ of the second discrimination unit 4*b* are sent to a fourth discrimination unit 4*d*. All discrimination units 4*a*, 4*b*, 4*c* and 4*d* of FIG. 5 are essentially identical. From the third discrimination unit 4*c* a signal FF is obtained which represents a front signal of second order. In the same way a signal RR is obtained from the fourth discrimination unit 4*d* which represents a rear signal of second order. These signals show a more distinctive directional pattern than signals F and R of the circuit of FIG. 2.

With the circuit of FIG. 5 it is possible to obtain a very high directionality of signals which is necessary in cases in which sound of a certain source is to be picked up without disturbance by ambient noise.

Figure 6:
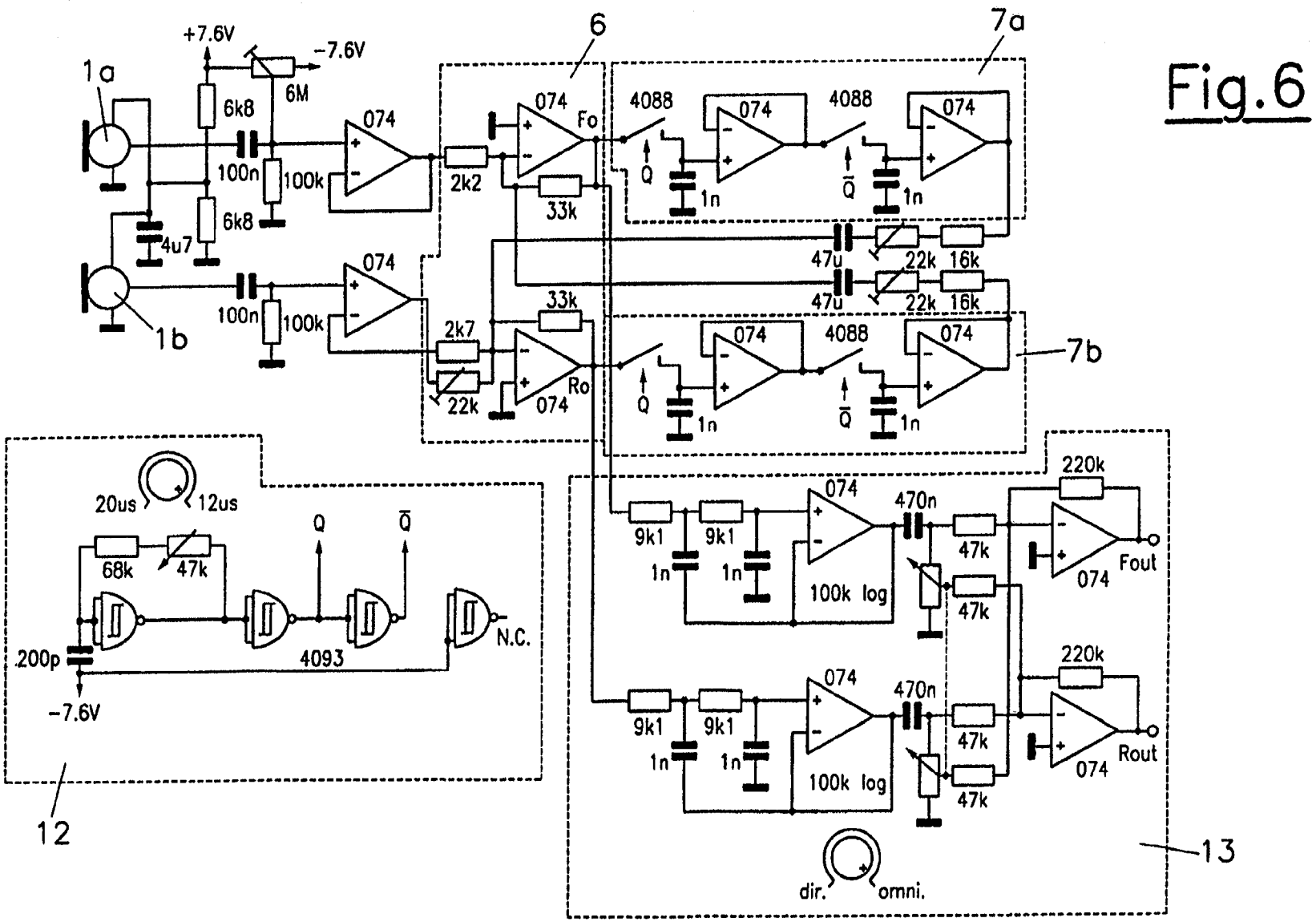

In FIG. 6 a detailed circuit of the invention is shown in which the method of the invention is realized as an essentially analog circuit. Microphones 1*a*, 1*b* are small electric pressure microphones as used in hearing aids. After amplification signals are led to the subtractors 6 consisting of inverters and adders. Delaying units 7*a*, 7*b* are realised by followers and switches driven by signals Q and Q' obtained from a clock generator 12. Low pass filters and mixing units for the signals F and R are contained in block 13.

Alternatively it is of course possible to process the signals of the microphones by digital processing.

Figure 7:
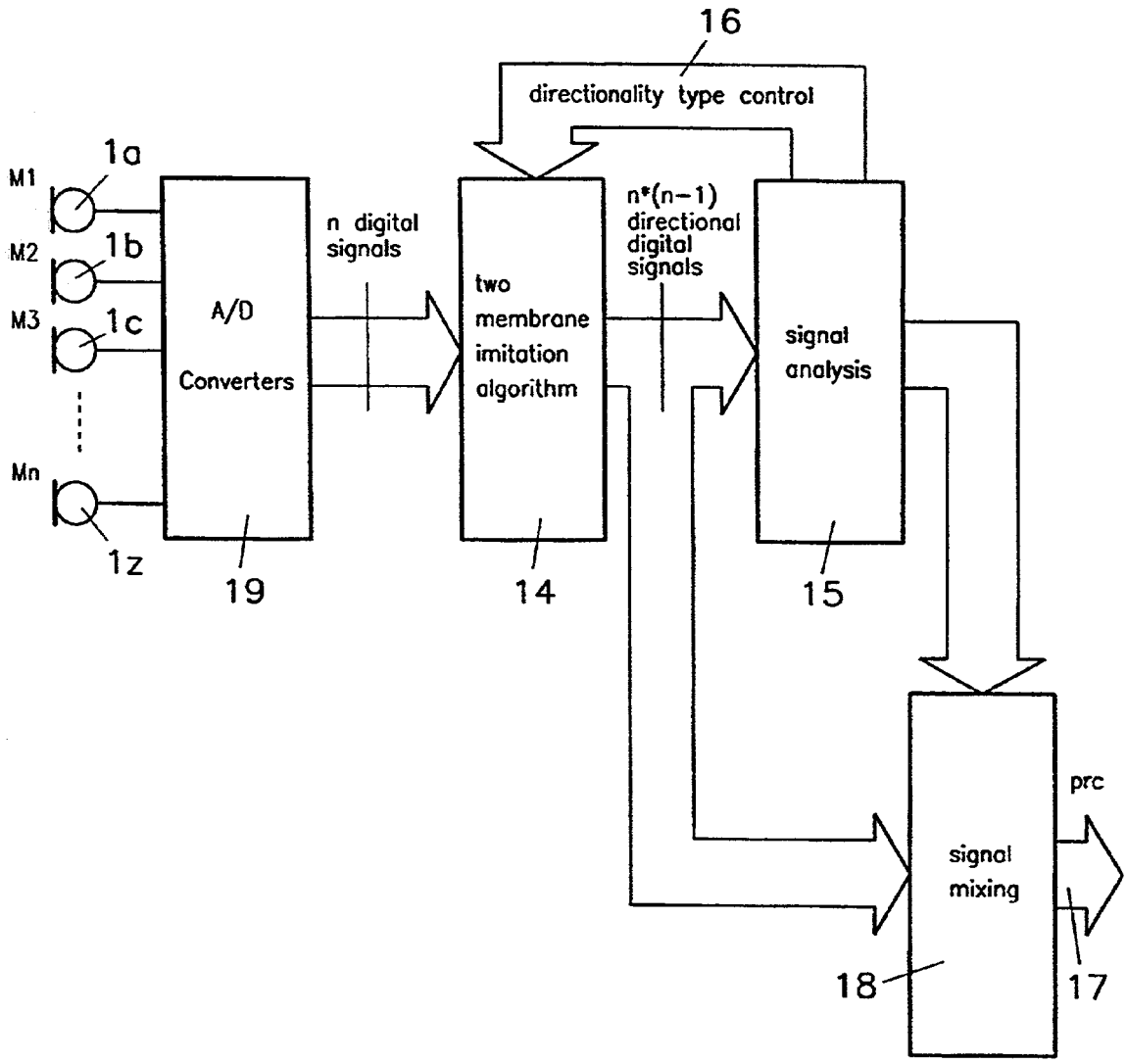

FIG. 7 shows a block diagram in which a set of a certain number of microphones 1*a*, 1*b*, 1*c*, . . . 1*z* are arranged at the corners of a polygon or a three dimensional polyhedron for example. After digitization in an A/D-converter 19 an n-dimensional discrimination unit 14 produces a set of signals. If the discrimination unit 14 consists of one discrimination unit of the type of FIG. 2 for each pair of signals, a set of n (n−1) directional signals for n microphones 1*a*, 1*b*, 1*c*, . . . 1*z* are obtained. In an analyzing unit 15 signals are analyzed and eventually feedback information 16 is given back to discrimination unit 14 for controlling signal processing. Further signals of discrimination unit 14 are sent to a mixing unit 18 which is also controlled by analyzing unit 15. The number of output signals 17 can be chosen according to the necessary channels for recording the signal.

Figure 8:
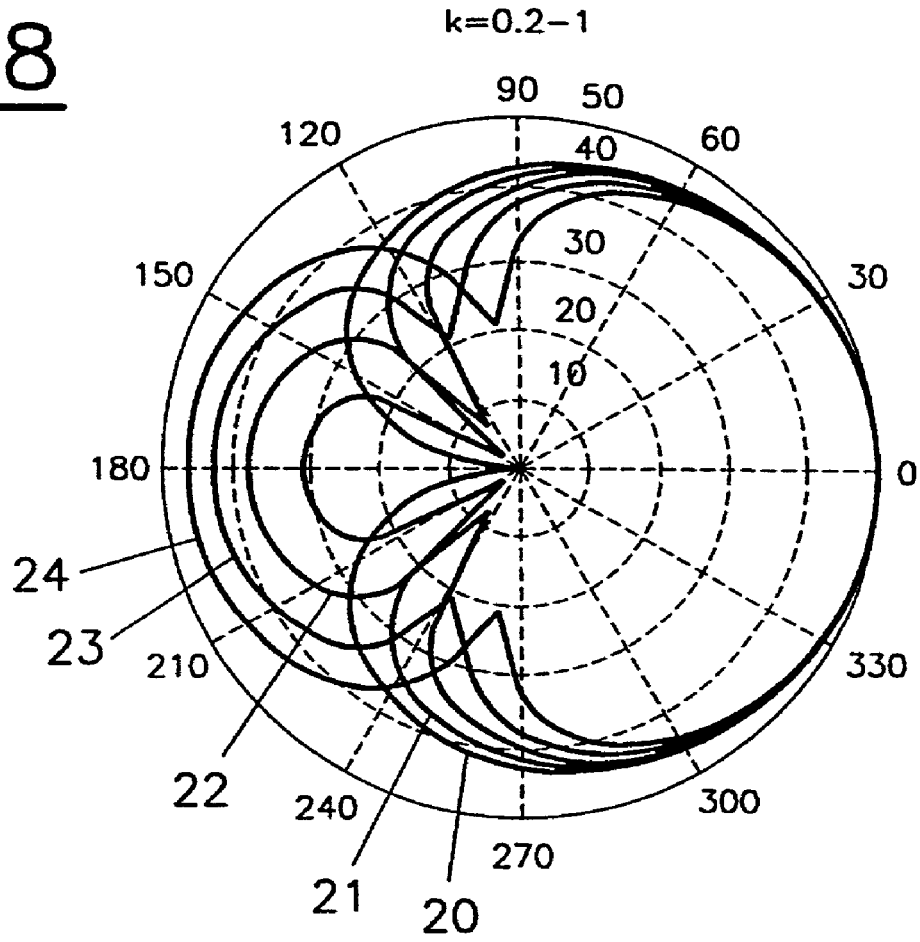

In FIG. 8 the result of numerical simulation is shown for different values of $T_0$. $T_0$ is chosen according the equation (7):

$$T_0 = k\frac{d}{c} \tag{7}$$

with k being a proportionality constant, d the distance between the two microphones, and c sound velocity. In case of k=1 the double membrane microphone of FIG. 3 is simulated so that a cardioid pattern (line 20) is obtained. For smaller values of k a hypercardioid pattern is obtained as shown with lines 21, 22, 23 and 24 for values of k=0.8; k=0.6; k=0.4; and k=0.2.

Figure 9:
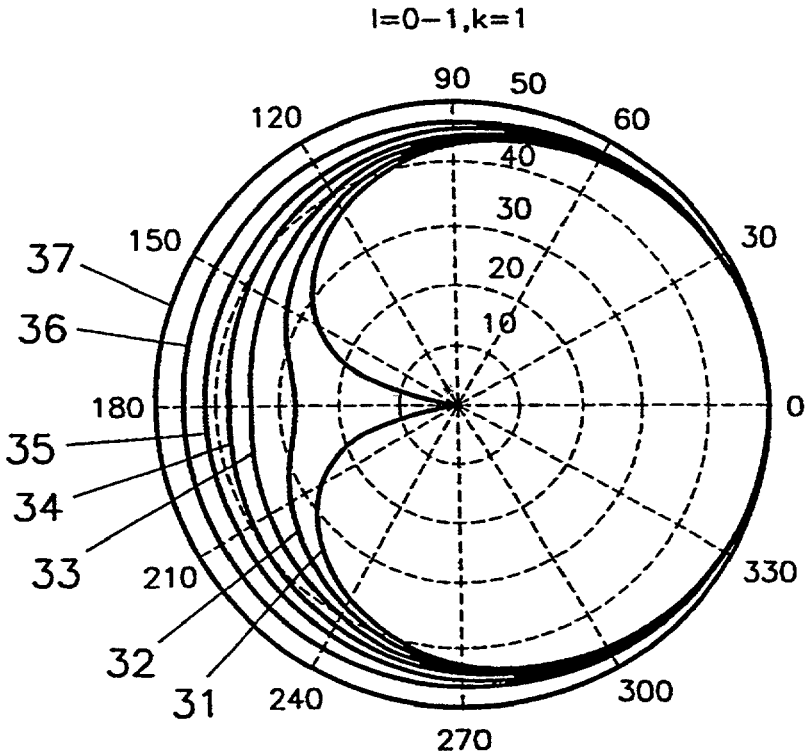

FIG. 9 shows the directional pattern for a signal processing according the following equation (8):

$$FF(t)=(1-\alpha)F(t)+\alpha R(t) \tag{8}$$

$$RR(t)=(1-\alpha)R(t)+\alpha F(t) \tag{9}$$

For $\alpha=0$ a cardioid pattern is obtained shown with line 31. For bigger values of $\alpha$ line 32, 33, 34, 35, 36 and 37 respectively are obtained. Line 37 represents an ideal omnidirectional pattern for $\alpha=½$. In FIG. 9 k was set to 1.

Figure 10:
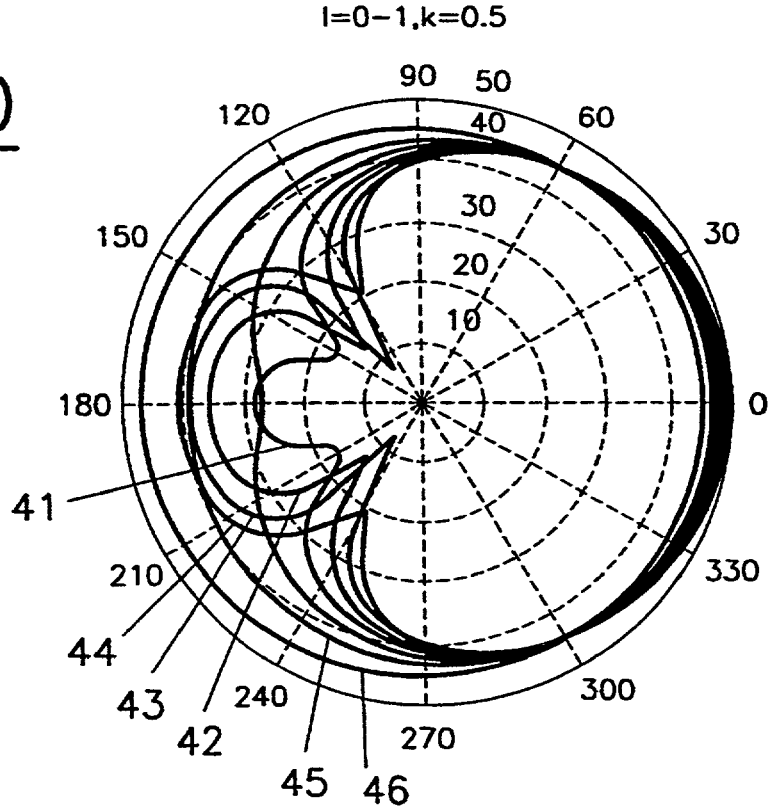

FIG. 10 shows the result with the same signal processing as in FIG. 9 according equations (8), (9) but with a value of k=0.5. Beginning with a hypercardioid 41 lines 42, 43, 44, 45 and 46 are obtained for increasing values of $\alpha$, wherein for $\alpha=½$, an omnidirectional pattern according to line 46 is obtained.

The present invention allows picking up sound with a directional sensitivity without frequency response or directional pattern being dependent on frequency of sound. Furthermore, it is easy to vary the directional pattern from cardioid to hyper-cardioid, bi-directional and even to omnidirectional pattern without moving parts mechanically.

The present invention has been described utilizing particular embodiments. As will be evident to those skilled in the art, changes and modifications may be made to the disclosed embodiments and yet fall within the scope of the present invention. The disclosed embodiments are provided only to illustrate aspects of the present invention and not in any way to limit the scope and coverage of the invention. The scope of the invention is therefore only to be limited by the appended claims.

What is claimed is:

1. An apparatus for picking up sound wherein at least three essentially omnidirectional microphones and at least three discrimination units are provided, wherein a first microphone is connected to an input port of the second and the third discrimination unit, the second microphone is connected to an input port of the first and the third discrimination unit, and the third microphone is connected to an input port of the first and the second discrimination unit, each discrimination unit comprising a first and a second subtractor, each of which has an input port connected with a first and at least another microphone respectively, a first and a second delaying unit having input ports connected with output ports of the first and the second subtractor respectively, for delaying the output signals a predetermined time, wherein an output port of the first delaying unit is connected to a negative input port of the second subtractor and wherein an output port of the second delaying unit is connected to a negative input port of the first subtractor.

2. An apparatus of claim 1, wherein a sound processing unit is provided to modify the directional pattern of the signals.

3. An apparatus of claim 1, wherein more than three microphones are provided which are arranged at the corners of a polygon or polyhedron and wherein a set of several discrimination units is provided, each of which is connected to a pair of microphones.

4. An apparatus for picking up sound with more than three essentially omnidirectional microphones which are arranged at the corners of a polygon comprising a set of discrimination units, each of which is connected to a pair of microphones, the discrimination units comprising or polyhedron, a first and a second subtractor, each of which having an input port connected with a first and at least another microphone respectively, a first and a second delaying unit having input ports connected with output ports of the first and the second subtractor respectively, for delaying the output signals a predetermined time, wherein an output port of the first delaying unit is connected to a negative input port of the second subtractor and wherein an output port of the second delaying unit is connected to a negative input port of the first subtractor.

5. An apparatus of claim 4, wherein a sound processing unit is provided to modify the directional pattern of the signals.

6. An apparatus for picking up sound with at least three essentially omnidirectional microphones which are arranged on a straight line and wherein a first and a second microphone are connected with the input ports of a first discrimination unit, and the second and the third microphones are connected to the input ports of a second discrimination unit and wherein a third discrimination unit is provided, the input ports of which are connected to an output port of the first and the second discrimination units and wherein preferably a fourth discrimination unit is provided, the input ports of which are connected to the other output ports of the first and the second discrimination units, wherein each discrimination unit comprises a first and a second subtractor, each of which having an input port connected with a first and at least another signal respectively, a first and a second delaying unit having input ports connected with output ports of the first and the second subtractor respectively, for delaying the output signals a predetermined time, wherein an output port of the first delaying unit is connected to a negative input port of the second subtractor and wherein an output port of the second delaying unit is connected to a negative input port of the first subtractor, the outputs of the discrimination units comprising the output ports of the first and second subtractors, respectively.

7. An apparatus of claim 6, wherein a sound processing unit is provided to modify the directional pattern of the signals.

* * * * *